US007207811B2

(12) United States Patent
Xu

(10) Patent No.: US 7,207,811 B2
(45) Date of Patent: Apr. 24, 2007

(54) ELECTRICAL CONNECTOR

(75) Inventor: Pei Ren Xu, Dollard des Ormeaux (CA)

(73) Assignee: Weco Electrical Connectors Inc., Québec (CA)

( * ) Notice: Subject to any disclaimer, the term of this patent is extended or adjusted under 35 U.S.C. 154(b) by 0 days.

(21) Appl. No.: 10/976,307

(22) Filed: Oct. 29, 2004

(65) Prior Publication Data

US 2005/0136755 A1 Jun. 23, 2005

(30) Foreign Application Priority Data

Dec. 18, 2003 (CA) ..... 2453637

(51) Int. Cl.
*H01R 12/00* (2006.01)

(52) U.S. Cl. ..... 439/83; 439/876

(58) Field of Classification Search ..... 439/83, 439/874, 876

See application file for complete search history.

(56) References Cited

U.S. PATENT DOCUMENTS 4,854,882 A 8/1989 Corridori
5,035,656 A * 7/1991 Patel ..... 439/733.1
5,709,574 A * 1/1998 Bianca et al. ..... 439/858
6,270,362 B1 8/2001 Guran et al.

FOREIGN PATENT DOCUMENTS

JP 11260487 * 9/1999

* cited by examiner

*Primary Examiner*—Truc Nguyen
(74) *Attorney, Agent, or Firm*—Shlesinger, Arkwright & Garvey LLP

(57) ABSTRACT

An electrical connector having an electrically non-conductive carrier, the carrier having a plurality of contact pin mounting holes extending there through. Each hole has a square cross-section. An electrically conductive contact pin is passed through each hole. A retainer is provided on the pin separating a leading pin section from a trailing pin section. The trailing pin section has a length slightly longer than the length of the hole and a diameter slightly less than the width of the hole. The retainer and the contact head both have a diameter at least slightly greater than the width of the hole to retain the pin in the hole. An electrical contact pin for use with such a multi-pin electrical connector, a method of inserting such contact pin may be provided.

16 Claims, 3 Drawing Sheets

ELECTRICAL CONNECTOR

CROSS-REFERENCE TO RELATED APPLICATIONS

This application claims the priority of Canadian application no. 2,453,637, filed Dec. 18, 2003, which is incorporated herein by reference.

FIELD OF THE INVENTION

This invention is directed toward an electrical connector and more particularly toward a multi-pin electrical connector to be surface mounted on a printed circuit board (PCB). The invention is also directed toward contact pins used with the electrical connector and to a method of assembling the connector.

BACKGROUND ART

Multi-pin electrical connectors for PCB surface mount technology are known. The connector has a support or carrier with a plurality of circular pin mounting holes extending through the carrier. The holes are usually in a straight line along the length of the carrier. The carrier is electrically non-conductive. A contact pin, generally cylindrical in shape, is mounted in each hole Each contact pin has a contact head on one side of the carrier and projects through the carrier to provide a leading pin section on the other side of the carrier. The pins are made of electrically conductive material. The connector is electrically connected to a PCB by soldering the contact head of the pins to the circuits on the board. A socket then connects another electrical device to the leading sections of the pins to connect the PCB to the device.

The contact pins usually have a tight fit in the holes in the carrier and remain fixed in position during assembly of the connector to the PCB with the contact heads tight against the carrier. However, with long carriers, there is more chance of uneven spacing between the carrier and the PCB and, with uneven spacing, one or more of the heads on the pins may not make good contact with the PCB. To overcome this problem, the pins have been mounted in a 'floating' manner in the carrier. By 'floating', it is meant that the pins are loosely mounted within the holes in the carrier and can have some movement in the longitudinal direction of the pins and the holes, relative to the carrier, and also in a transverse direction to the holes, relative to the carrier The ability to move longitudinally, relative to the carrier, allows the heads of the pins to make good contact with the PCB even if there is some uneven spacing between the carrier and the PCB.

In order to retain the 'floating' pins in place in the holes in the carrier, the pins are provided with retaining means on the pin spaced from the head of the pin. The retaining means are usually in the form of a collar as shown, for example, in U.S. Pat. Nos. 4,854,882 and 6,270,362. This collar is slightly larger than the hole to prevent withdrawal of the pin from the hole. The collar is also spaced from the head of the pin a distance slightly more than the length of the hole the pin passes through. This spacing allows the pin to 'float' to provide good contact between the head of the pin and the PCB during soldering.

The 'floating' pins are mounted on the carrier by forcing the collar on the pin through the hole. However, since the collar is larger than the hole, and the carriers are usually made from relatively rigid material to properly locate the pins for soldering, the carrier often cracks during mounting of the pins and must be replaced resulting in waste and added cost.

SUMMARY OF THE INVENTION

It is the purpose of the present invention to provide a connector with 'floating' pins that can be more easily and readily assembled with minimum breakage of the carrier. It has been discovered that the cylindrical pins, with the retaining means thereon, can be more easily pushed through the holes in the carrier if the holes are square in cross-section instead of circular while reducing cracking or breaking of the carrier. The retaining means on the pin are in the form of a collar having a leading conical portion. The conical portion deforms the square hole to a shape more closely approximating the circular plan shape of the conical portion as it passes through. The hole returns substantially to its original square shape after the retaining mean has passed through.

To make the passage of the retaining means on-the pin through the hole easier, at least part of the leading section of the pin, in front of the retaining means, can be slightly larger in diameter than the width of the hole. As the leading pin section is pushed through the hole, the part that is slightly larger in diameter produces a slight initial deformation of the hole with final deformation of the hole being formed by the passage of the collar. This two-stage deformation process, during mounting of the pins, makes it easier to push the retaining means through the hole further minimizing breakage of the carrier.

To make the passage of the retaining means even easier, it is preferred that the carrier is made from resilient material having an elongation of about 5% so that it more easily deforms without breaking.

The invention is particularly directed to an electrical connector having an electrically nonconductive carrier, the carrier having a plurality of contact pin mounting holes extending there through. Each hole has a square cross-section. An electrically conductive contact pin is passed through each hole. Each contact pin has a generally cylindrical shape with a leading pin section, a trailing pin section, and a contact head at the end of the trailing pin section. Retaining means are provided on the pin separating the leading pin section from the trailing pin section. The trailing pin section has a length slightly longer than the length of the hole and a diameter slightly less than the width of the hole. The retaining means and the contact head both have a diameter at least slightly-greater than the width of the hole to retain the pin in the hole.

The invention is also particularly directed toward an electrical contact pin for use with a multi pin electrical connector adapted to be surface mounted on a printed circuit board. The contact pin is generally cylindrical in shape and has a leading pin section, a trailing pin section, and retaining means integral with the pin and located between the leading pin section and the trailing pin section. A contact head is provided at the free end of the trailing pin section. The retaining means is in the form of a collar with a leading conical portion adjacent the leading pin section and a trailing cylindrical portion adjacent the trailing pin section.

The invention is further particularly directed toward a method of inserting an electrically conductive, cylindrical, contact pin into a square hole on a non-electrically conductive carrier, the contact pin having a leading pin section with at least a portion having a diameter slightly greater than the width of the hole and retaining means behind the leading pin section having a diameter greater than the diameter of the portion of the leading pin section, the method comprising pushing the leading pin section into and through the hole to initially deform the hole, and continuing to push the pin to move the retaining means through the hole to complete deformation of the hole to pass the retaining means through the hole.

BRIEF DESCRIPTION OF THE FIGURES IN THE DRAWINGS

DESCRIPTION OF THE PREFERRED EMBODIMENT OF THE INVENTION

Figure 1:
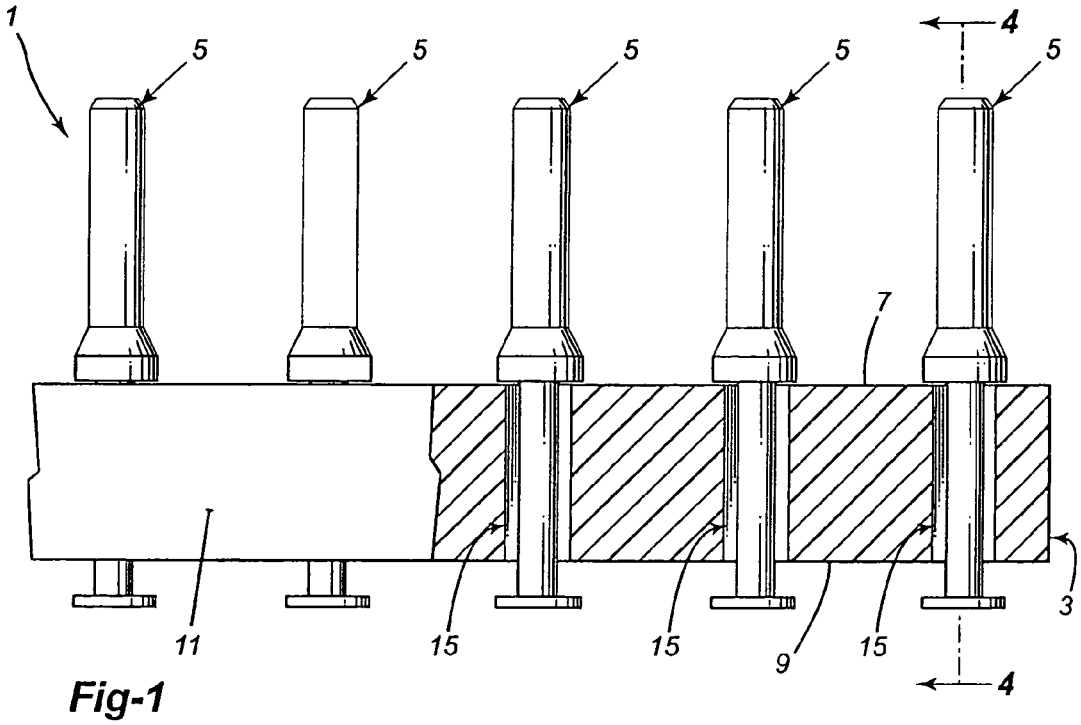
FIG. 1 is a partial elevation view of a connector in partial section.
Figure 2:
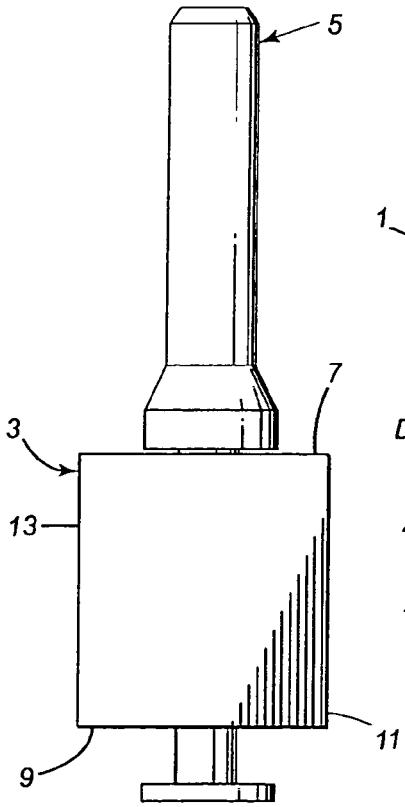
FIG. 2 is an end view of the connector shown in FIG. 1.

The electrical connector as shown in FIGS. 1 and 2, has a carrier 3 with a plurality of contact pins 5 mounted on the carrier. The carrier 3 has a rectangular cross-sectional shape with the short sides of the shape forming the top and bottom sides 7, 9 of the carrier and the long sides forming the vertical sides 11, 13 of the carrier. A series of contact pin mounting holes 15 extend through the carrier 3 between its top and bottom sides 7, 9. The holes 15 are normally equally spaced apart along the length of the carrier 3 and are normally centered between the vertical sides 11, 13 of the carrier. In accordance with the present invention, the holes 15 have a square cross-sectional shape. While the carrier 3 has been described as having a rectangular cross-sectional shape it could have other shapes as well.

Figure 3:
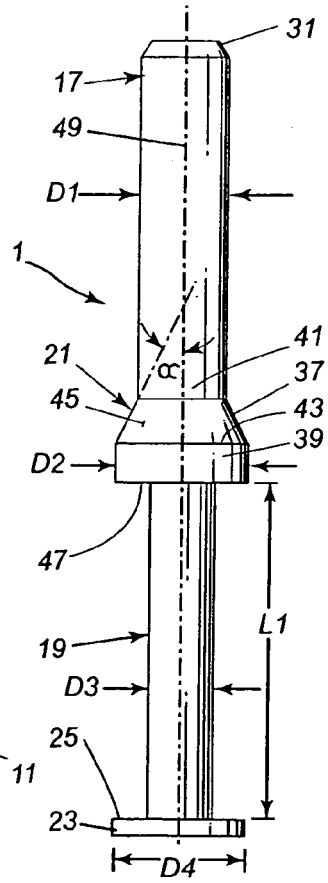
FIG. 3 is an elevation view of the contact-pin.
Figure 4:
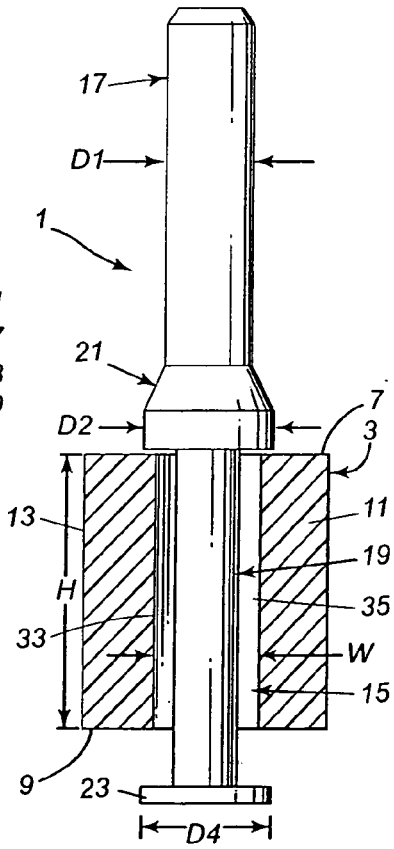
FIG. 4 is a cross-section view along line 4—4 in FIG. 1.

The contact pins 5 are generally cylindrical in shape. Each pin 5, as shown in FIGS. 3 and 4, has a leading pin section 17, and a trailing pin section 19. Retaining means 21 are provided on the pin 5 between the connecting and trailing pin sections 17, 19. The retaining means 21 are integral with the pin. A contact head 23 is provided at the free end of the trailing pin section 19.

Leading pin section 17 has a chamfered front end 31 and a diameter D1 that is slightly less than the width W of the square hole 15, the width W defined by the distance between two opposed sides 33, 35 of the hole. The retaining means 21 is in the form of a collar and has a leading truncated conical portion 37 and a trailing cylindrical-portion 39. The conical portion 37 extends outwardly and rearwardly from the rear end 41 of the leading pin section 17 to the front end 43 of the trailing portion 39 and forms an angled surface 45. The trailing portion 39 has a diameter D2 that is greater than the width W of the hole 15. The trailing pin section 19 has diameter D3 that is slightly less than the width W of the hole. The contact head 23 has a diameter D4 that is greater than the width W of the hole.

While the retaining means 21 has been described to have a leading truncated conical portion 37 and a trailing cylindrical portion 39 it could be employed with other configurations as well. For example, the trailing cylindrical portion 39 could be omitted leaving only the truncated conical portion. Or the retaining means could have the leading conical portion employed with a trailing, truncated, conical portion, the trailing portion tapering back from the back of the leading portion. A trailing portion is preferred on the retaining means to strengthen the conical portion and prevent shearing off of the outer rim of the leading conical portion The distance L1, between the back 47 of the collar and the contact head 23 is just slightly greater than the height H of the carrier 3. The angle $\alpha$ between the angled surface 45 of conical portion 37 of the collar-and longitudinal axis 49 of the pin should be no greater than 30° and no less than 20°.

Figure 5:
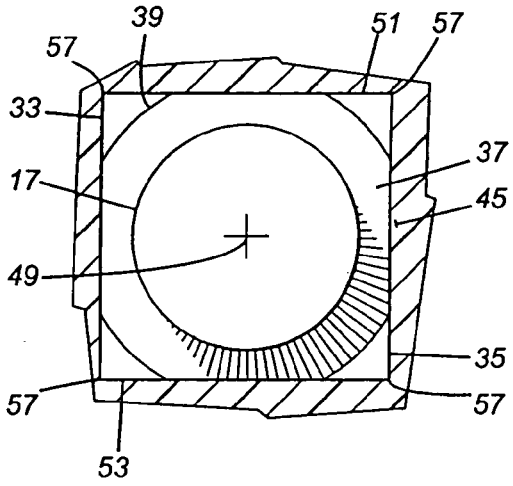
FIGS. 5 and 5A are cross-section views of the square hole with the connecting pin section therein.
Figure 6:
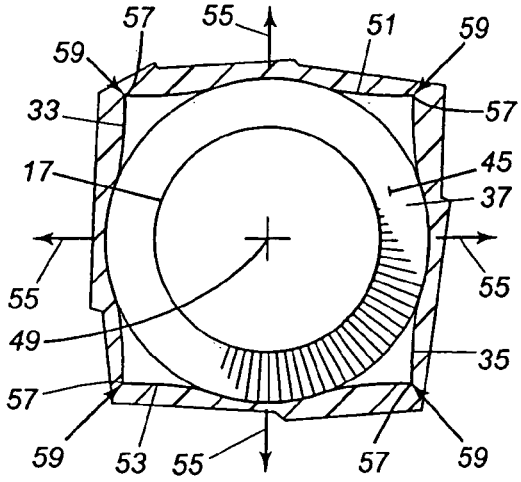
FIGS. 6 and 6A are cross-section views of the square hole with the retaining means therein.
Figure 5A:
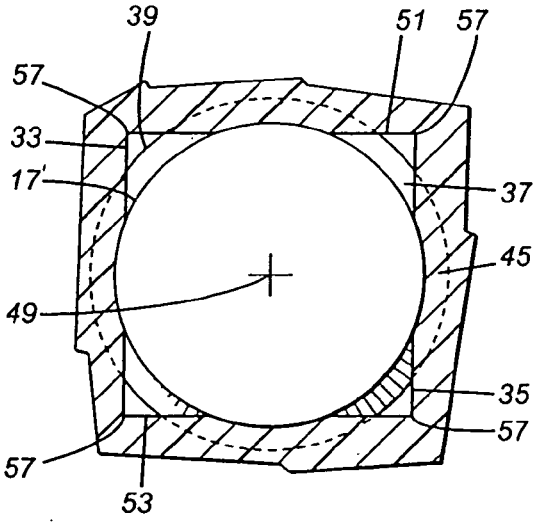
Figure 6A:
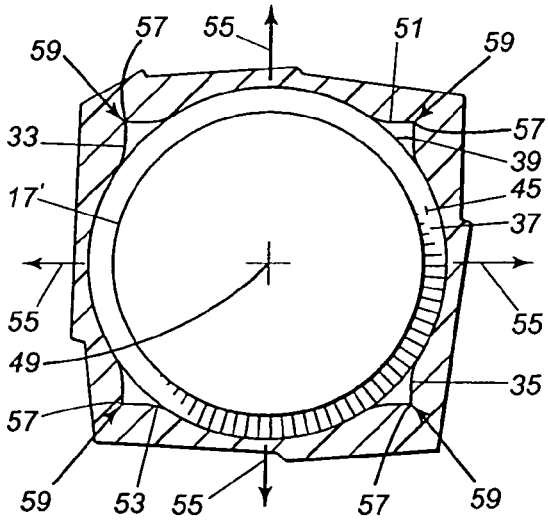

In use, the cylindrical pin 5 is initially inserted into the square hole 15 from the bottom side of the carrier 3. The pin 5 is then pushed into the hole 15, the leading pin section 17 leading the way, and freely entering the hole as shown in FIG. 5. As the collar enters the hole, the conical portion 37 begins to deform the hole 15 and shape it to more closely fit the circular shape of trailing portion 39 as shown in FIG. 6. As the hole 15 is deformed by the collar passing through the hole, the sides 33, 35, 51, 53 of the hole bow outwardly as shown by the arrows 55 and the corners 57 of the hole move slightly inwardly toward the longitudinal axis 49 of the hole, as shown by the arrows 59 to have the hole assume a more circular shape at the vicinity of the trailing portion 39 of the collar. The material of the carrier defining the hole flows over the collar as the pin passes through the hole and the hole returns substantially to its original shape behind the collar. The trailing cylindrical portion 39 of the collar allows the portion of the carrier defining the hole to more gradually make the transition from its deformed more circular shape back to its square shape. Once the collar emerges from the hole 15, the pushing action is terminated and the pin 5 is mounted in place on the carrier. The pin 5 is loosely retained in the hole 15 by the head 23 on one end and the collar or retaining means 21 on the other end.

The pin 5 is slightly movable vertically in the hole since the trailing pin section 19 is slightly longer than the length of the hole 15. The pin 5 is also slightly movable transversely in the hole since the trailing section 19 is slightly smaller in diameter than the width of the hole. This allows the pins 5 to 'float' in the carrier 3 making it easier to have all the heads 23 on the pins make good contact with the PCB when soldering the pins to the PCB. The 'floating' pins also allow the assembled unit to compensate for any lateral thermal expansion of the carrier relative to the PCB.

In a preferred embodiment of the invention shown in FIGS. 5A, 6A, 7 and 8, the leading section 17' of the pin 5' is made with a diameter D5 that is slightly greater than the width W of the hole 15. With this pin configuration the leading pin section 17', upon initial insertion into the hole 15 from the bottom side 9 of the carrier, initially begins slight deformation of the hole making it easier for the retaining means 21' to complete deformation of the hole and allowing its passage through the hole. This two stage deformation process further reduces the chances of the carrier breaking during passage of the retaining means.

Figure 7:
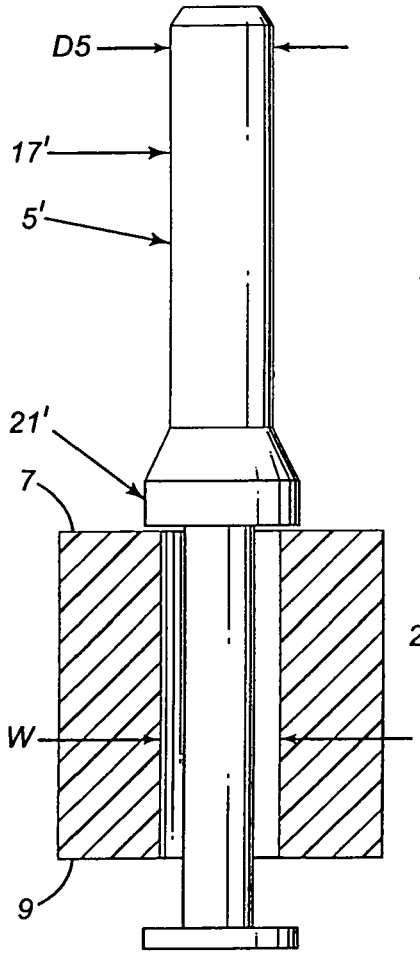
FIG. 7 is an elevation view of a preferred contact pin.
Figure 8:
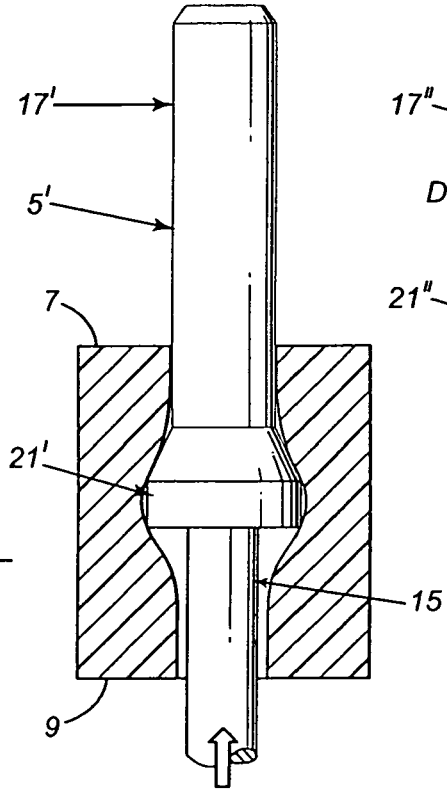
FIG. 8 is a partial cross-section view showing the pin of FIG. 7 passing through the hole.
Figure 9:
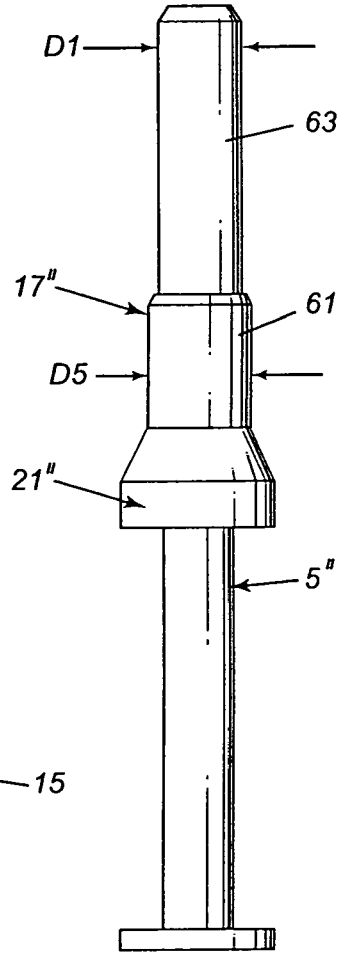
FIG. 9 is a modification of the pin shown in FIG. 7.

While the embodiments in FIGS. 7 and 8 show the entire leading pin section 17' as being enlarged relative to the hole 15, only a portion need be enlarged. As shown in FIG. 9, only a short portion 61 of the leading pin section 17" of the pin 5", adjacent the retaining means 21", need be enlarged to a diameter D5 that is slightly larger than the width W of the hole The remaining front portion 63 of the leading pin section 17" can be a diameter D1, that is slightly less than the width w 5 of the hole 15. This pin 5" also provides a two-stage deformation of the hole during passage of the retaining means 21" through the hole but it allows easier initial insertion of the pin into the hole because of the smaller front portion 63 on the leading pin section 17".

The retaining means 21 (and 21' and 21" as well) is made long enough to prevent its outer circular portion from shearing off. The angle ax of the tapered portion 37 should not exceed 30°. If the angle exceeds 30°, the retaining means may deform the carrier beyond its elastic limit. The angle $\alpha$ also should not be less than 20° so as to avoid unduly lengthening the pin.

The relationship of the size of the square hole and the diameter of the collar is a very important consideration in the present invention. A simple formula which has been found to give satisfactory results is as follows:

$$D2=(1.11 \text{ to } 1.16)W$$

where D2 is the largest diameter of the collar and W is width of one side of the square hole.

The formula gives a maximum cross-sectional area of the collar that is about 6% larger than the area of the square hole. Anything larger could cause cracking of the carrier during insertion of the pin. The formula also gives a minimum cross-sectional area of the collar that is about 3% less than the cross-sectional area of the square hole. This ensures retention of the pin in the hole after the collar has been pushed through the hole.

The carrier 3 is made from a high temperature resistant polyamide, the polyamide preferably containing glass fiber. This material falls under material class PA46, manufactured by DSM and sold under the trade mark STANYL. This material has an elongation of about 5%. The material is also able to withstand temperatures of at least 260° C. which is around the temperature at which the soldering of the connector to the PCB takes place. The resiliency and elongation characteristics of this material, when used for the carrier, further reduces the chances of the carrier breaking during insertion of the pins. It has been found that insertion of the pins can be carried out efficiently and successfully in an environment in which the temperature is between 20° and 25° C. and the relative humidity is between 40 and 50 percent.

The pins 5, 5', 5", are made from solid brass. One form of acceptable brass is C35300 "High Leaded Brass" alloy. Another form of acceptable brass is C38500 "Architectural Bronze" alloy. Brass is a preferred material because it is easily machined and resistant to corrosion.

By way of example, for standard 5 mm pitch contact pins made in the preferred embodiment, the width W of the square hole would be about 1.05 nm; the diameter D5 of the leading pin section would be about 1.07 mm; the diameter D2 of the circular trailing portion 39 of the collar would be about 1.2 mm; and the diameter D3 of the trailing pin section 19 would be about 0.97 mm The contact head 23 extends below the bottom of the carrier 3 by about 1.5 mm. The dimensions would be different for standard 3.5 mm and 7.0 mm pitch contact pins but in the same proportion as above.

While this invention has been described as having a preferred design, it is understood that it is capable of further modifications, and uses adaptions of the invention and including such departures from the present disclosure as come within the known or customary practice in the art to which the invention pertains, and as may be applied to the central features hereinbefore set forth, and fall within the scope of the invention or limits of the claims appended hereto.

The invention of claimed is:

1. An electrical contact pin for use in a multi pin electrical connector adapted to be surface mounted on a printed circuit board, the contact pin to be mounted through a square hole in a carrier, the contact pin generally cylindrical in shape and having: a leading pin section, a trailing pin section, a contact head at the free end of the trailing pin section, and retaining means integral with the pin and located between the leading pin section and the trailing pin section; the retaining means in the form of a collar with a leading truncated conical portion adjacent the leading pin section and a trailing cylindrical portion adjacent the trailing pin section, the retaining means sized to temporarily deform the square hole when mounted through the hole.

2. A contact pin as claimed in claim 1 wherein the diameter of the collar is between 1.11 and 1.16 of the width of the hole the pin is to be mounted in.

3. A contact pin as claimed in claim 1 wherein the leading pin section has at least a portion adjacent the retaining means that has a diameter slightly larger than the width of the hole it is to be mounted in.

4. A contact pin as claimed in claim 2 wherein the leading pin section has at least a portion adjacent the retaining means that has a diameter slightly larger than the width of the hole it is to be mounted in.

5. A contact pin as claimed in claim 1 wherein the truncated conical portion provides an angled surface extending rearwardly from the leading pin portion and outwardly at an angle of between 20° and 30° to the longitudinal axis of the pin.

6. A contact pin as claimed in claim 2 wherein the truncated conical portion provides an angled surface extending rearwardly from the leading pin portion and outwardly at an angle of between 20° and 30° to the longitudinal axis of the pin.

7. An electrical connector having an electrically non-conductive carrier, the carrier having a plurality of contact pin mounting holes extending there through, each hole having a square cross-section; an electrically conductive contact pin passed through at least some of the holes, each contact pin having a generally cylindrical shape with a leading pin section, a trailing pin section, and a contact head at the end of the trailing pin section; retaining means in the form of a collar on the pin separating the leading pin section from the trailing pin section, the collar having a leading truncated conical portion and a trailing cylindrical portion, the trailing pin section having a length slightly longer than the length of the hole and a diameter slightly less than the width of the hole, the retaining means and the contact head both have a diameter at least slightly greater than the width of the hole to retain the pin in the hole, the retaining means sized to temporarily deform the square hole into a more circular shape while being passed through the hole.

8. A connector as claimed in claim 7 wherein the truncated conical portion provides an angled surface extending rearwardly from the leading pin portion and outwardly at an angle of between 20° and 30° to the longitudinal axis of the pin.

9. A connector as claimed in claim 7 wherein at least a portion of the leading pin section, adjacent the retaining means, has a diameter slightly greater than the width of the square hole, the remainder of the leading pin section having a diameter slightly less than the width of the hole.

10. A connector as claimed in claim 7 wherein the diameter of the collar is between 1.11 and 1.16 of the width of the square hole.

11. A connector as claimed in claim 7 wherein the carrier is made from a PA46 material having high temperature resistance and an elongation of around 5%.

12. A connector as claimed in claim 8 wherein at least a portion of the leading pin section, adjacent the retaining means, has a diameter slightly greater than the width of the square hole, the remainder of the leading pin section having a diameter slightly less than the width of the hole.

13. A connector as claimed in claim 8 wherein the diameter of the collar is between 1.11 and 1.16 of the width of the square hole.

14. A connector as claimed in claim 9 wherein the diameter of the collar is between 1.11 and 1.16 of the width of the square hole.

15. A connector as claimed in claim 12 wherein the diameter of the collar is between 1.11 and 1.16 of the width of the square hole.

16. A connector as claimed in claim 10 wherein the carrier is made from a PA46 material having high temperature resistance and an elongation of around 5%.

* * * * *